United States Patent [19]

Barito et al.

[11] Patent Number: 5,040,956

[45] Date of Patent: Aug. 20, 1991

[54] MAGNETICALLY ACTUATED SEAL FOR SCROLL COMPRESSOR

[75] Inventors: Thomas R. Barito, East Syracuse; Howard H. Fraser, Jr., Lafayette, both of N.Y.

[73] Assignee: Carrier Corporation, Syracuse, N.Y.

[21] Appl. No.: 452,287

[22] Filed: Dec. 18, 1989

[51] Int. Cl.[5] ..... F04C 18/04; F04C 27/00; F16J 9/26; F16J 15/16

[52] U.S. Cl. ..... 418/1; 418/55.4; 418/55.5; 418/57; 277/80

[58] Field of Search ..... 418/1, 55.4, 55.5, 57; 277/80

[56] References Cited

U.S. PATENT DOCUMENTS

| | | | |
|---|---|---|---|
| 3,128,104 | 4/1964 | Teske | 277/80 |
| 4,240,228 | 12/1980 | Okamura | 277/80 |
| 4,343,599 | 8/1982 | Kousokabe | 418/88 |
| 4,365,941 | 12/1982 | Tojo et al. | 417/372 |
| 4,472,120 | 9/1984 | McCullough | 418/83 |
| 4,473,343 | 9/1984 | Hazaki et al. | 418/57 |
| 4,548,556 | 10/1985 | Terauchi | 418/57 |
| 4,549,861 | 10/1985 | Blain | 418/88 |
| 4,555,224 | 11/1985 | Hazaki et al. | 418/88 |
| 4,575,320 | 3/1986 | Kobayashi et al. | 418/94 |
| 4,600,369 | 7/1986 | Blain | 418/57 |
| 4,637,786 | 1/1987 | Matoba et al. | 418/88 |
| 4,645,437 | 2/1987 | Sakashita et al. | 418/57 |
| 4,726,100 | 2/1988 | Etemad et al. | 29/407 |
| 4,730,375 | 3/1988 | Nakamura et al. | 418/142 |
| 4,743,181 | 5/1988 | Murayama et al. | 418/57 |
| 4,762,478 | 8/1988 | Sakurai et al. | 418/151 |
| 4,795,323 | 1/1989 | Lessie | 418/55.3 |
| 4,811,471 | 3/1989 | Etemad et al. | 29/428 |

FOREIGN PATENT DOCUMENTS

| | | | |
|---|---|---|---|
| 2446971 | 9/1980 | France | 277/80 |
| 59-212571 | 12/1984 | Japan | 277/80 |
| 63-106388 | 5/1988 | Japan | 418/57 |

*Primary Examiner*—John J. Vrablik

[57] ABSTRACT

A back pressure chamber seal for use in a scroll type compressor that is located between the adjacent surface on the back of the orbiting scroll and the machine casing. Seals are loosely received in endless grooves formed in one of the two adjacent surfaces and are magnetically held in contact against the other adjacent surface and one wall of the groove to provide a sealed region. A pressurized fluid is delivered into the sealed region to provide an axially disposed biasing force acting against the orbiting scroll.

7 Claims, 3 Drawing Sheets

MAGNETICALLY ACTUATED SEAL FOR SCROLL COMPRESSOR

BACKGROUND OF THE INVENTION

In a scroll compressor the trapped volumes are in the shape of lunettes and are defined between wraps or elements of fixed and an orbiting scroll and the scroll end plates. The lunettes are generally crescent in form with the lunettes extending about 360° about the assembly with the two ends thereof defining points of contact between the coacting wraps. As the orbiting scroll moves through its orbital path of motion, the points of contact between the wraps move continuously toward the center of the assembly to reduce the volume of the lunettes and thus compress the fluid trapped therein. The pressure of the fluid continues to increase until it reaches a centrally located compressor discharge. A varying pressure gradient is thus felt across the scroll which tends to both axially and radially displace the scroll as it moves through an orbital path of motion.

Eccentric bushings, swing link connectors, slide blocks and the like have all been used to insure radial compliance of the orbiting scroll. These approaches all utilize the centrifugal forces produced by the orbiting scroll to hold the scroll wraps in sealing contact during the compression process. A number of approaches have also been used to counter the axial forces acting upon the orbiting scroll. The pressure of a fluid being compressed as well as that from an external source have been used to provide a biasing pressure against the back of the orbiting scroll. U.S. Pat. Nos. 3,600,114; 3,294,977 and 3,994,633 show examples of some of these back pressure devices.

In some compressors, a back pressure chamber is located immediately behind the back plate of the orbiting scroll and is provided with a perimeter seal that traps a high pressure fluid within the sealed region Springs are sometimes placed against the seals to mechanically bias them in sealing contact. The springs, however, will weaken with usage and localized leaks can develop thus destroying the integrity of the back pressure chamber. The spring also places an additional torque on the system which must be overcome by the compressor motor.

SUMMARY OF THE INVENTION

It is therefore an object of the present invention to improve scroll type compressors.

It is a further object of the present invention to improve the seals used in a back pressure chamber of a scroll compressor.

A still further object of the present invention is to reduce the amount of torque created in a scroll compressor by back pressure chamber seals.

Another object of the present invention is to prevent pressurized fluids from escaping from the back pressure chamber of a scroll compressor.

These and other objects of the present invention are attained by means of a seal for use in a scroll type compressor wherein an orbiting scroll is mounted within a compressor casing to coact with a stationary scroll to compress a fluid captured between the scroll wraps. A flat surface on the back of the orbiting scroll is positioned adjacent to a complementary surface on the machine casing so that a gap is established between the two opposing surfaces when the orbiting scroll is moving. At least one circular groove is formed in one of the opposing surfaces and a compliant seal is loosely contained within the groove. The seal contains a magnetic component that serves to draw the seal into contact against the opposing surface and, preferably against one of the side walls of the retaining groove. A high pressure fluid is supplied to the back pressure chamber bounded by the seal which produces a biasing force for resisting axial forces tending to unbalance a tip the orbiting scroll structure. In a further embodiment of the invention, a series of radially disposed endless grooves are formed in one of the opposing surfaces and a seal having a magnetic component is loosely contained within each of the grooves to establish a plurality of sealed regions, one inside the other, between the orbiting scroll and the machine casing. The pressure maintained in each of these sealed regions is controlled so that a plurality of back pressure areas are formed at various pressures. The pressurized fluid is drawn from different regions within the compressor so that the biasing pressure resisting the axial forces is closely matched to the loading acting upon the scroll structure.

BRIEF DESCRIPTION OF THE DRAWINGS

For a better understanding of these and other objects of the present invention, reference will be made to the drawings which are to be read in conjunction with the following detailed description of the invention, wherein.

DESCRIPTION OF THE INVENTION

Figure 1:
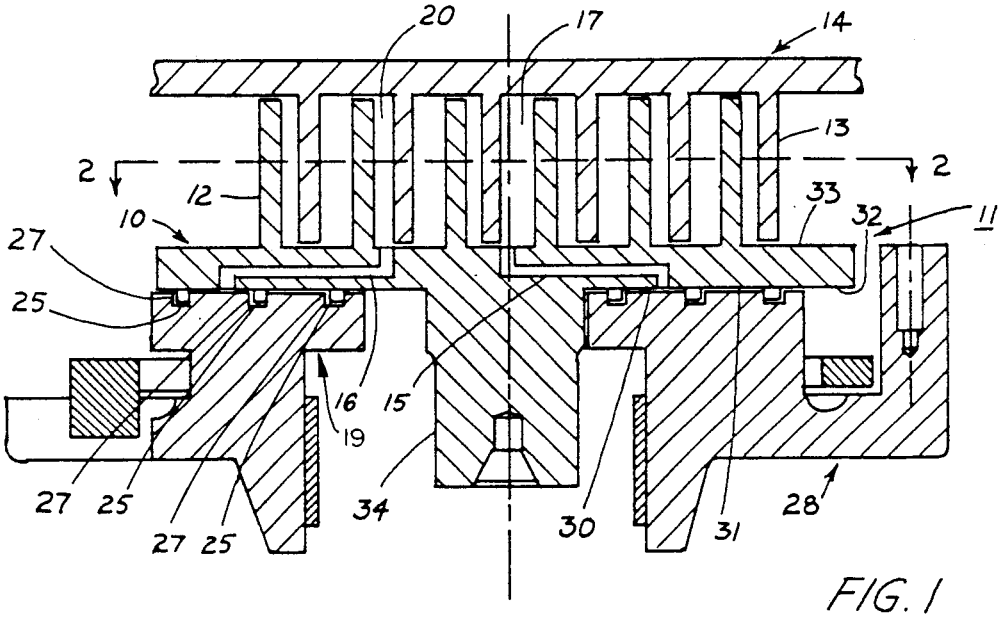
FIG. 1 is partial side elevation in section showing a stationary scroll and a orbiting scroll mounted within a compressor casing.
Figure 2:
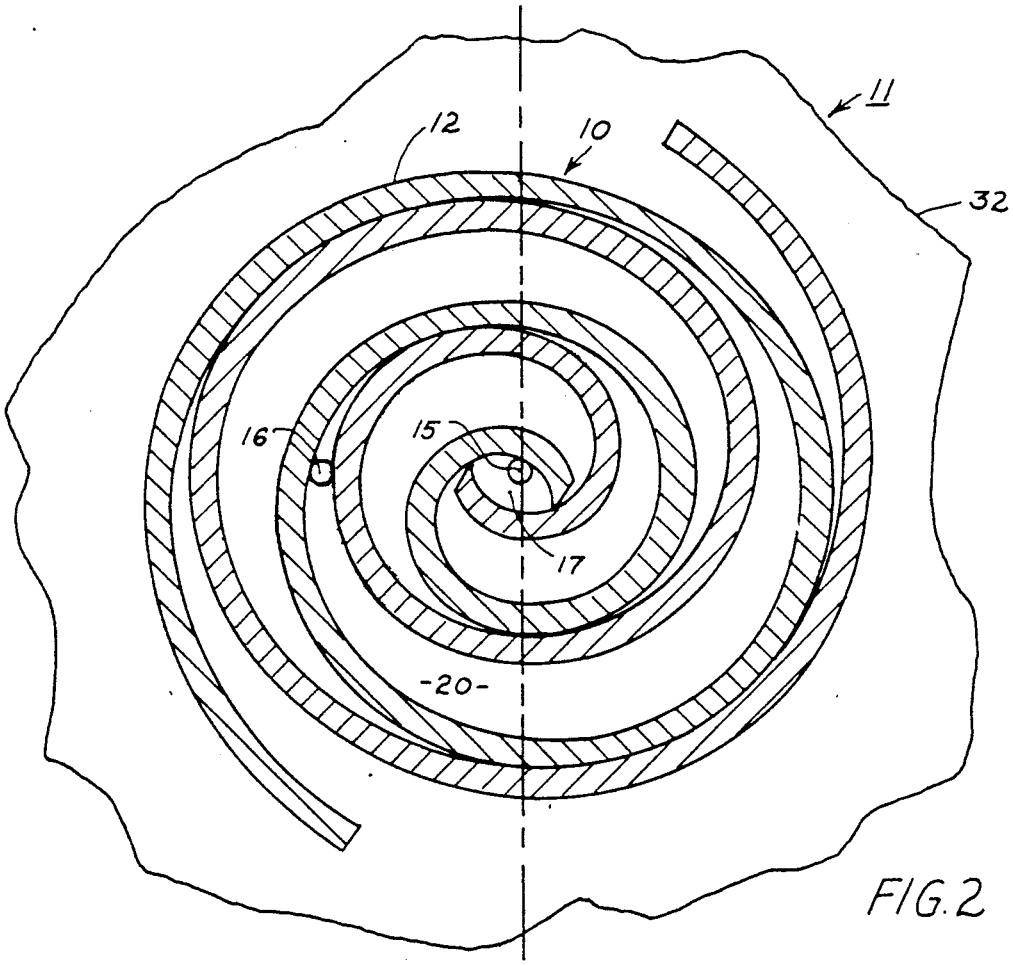
FIG. 2 is a top view showing the scroll wraps in section.
Figure 3:
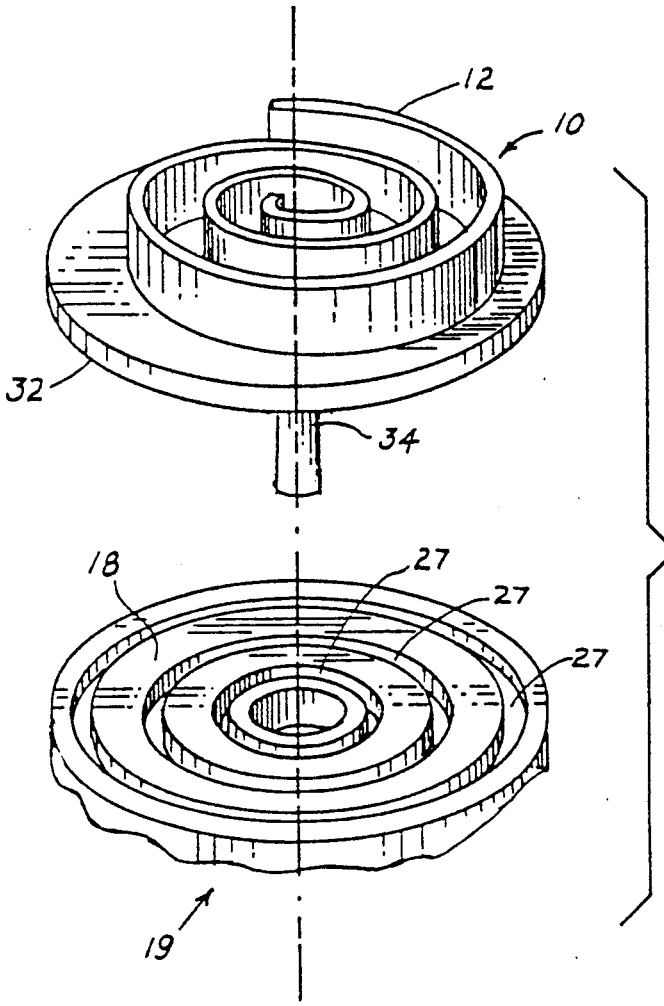
FIG. 3 is an exploded perspective view showing the orbiting scroll and machine casing illustrated in FIG. 1.

Referring FIGS. 1-3, the numeral 10 generally designates an orbiting scroll which is in scroll type compressor 11. The orbiting scroll has a wrap 12 co-acts with similar wrap 13 mounted upon a fixed scroll 14. The orbiting scroll also contains a pair of internal passages which include an inner flow channel 15 and an outer flow channel 16. It will be noted that channel 15 is in fluid flow communication with a lunular pocket 17 (FIG. 2). Similarly, channel 16 is in fluid flow communication with a second lunular pocket 20. Circular seals 25—25 (FIG. 1) are mounted in radially disposed grooves 27—27 formed in the end face 18 of casing member 19 which forms a part of the machine casing 28 (FIG. 1). As will be explained in a greater detail below, the seals function to isolate the back pressure chamber regions 30 and 31 so that a pressurized fluid can be maintained between the end face 18 of casing member 19 and the end face 32 of the orbiting scroll back plate 33.

In operation, the orbiting scroll is driven by a hub 34 which, in turn, is connected to a drive shaft (not shown). The scroll moves with respect to chamber regions 30 and 31 so that the chamber regions change their relative positions with respect to the end face 32 of the orbiting scroll. As the wrap 12 of the orbiting scroll 10 moves with respect to the wrap 13 of the fixed scroll, fluid becomes trapped within the volumes formed therebetween and is forced inwardly towards the center of the scroll assembly. The volumes thus continually shrink and the pressure in the trapped fluid is increased as the fluid moves inwardly toward the center of the assembly. Accordingly, channel 15 is exposed to the normally higher compressor discharge pressure while channel 16 is normally exposed to a lesser or intermediate pressure. It should be noted that the pressure in each chamber region may vary in response to changes in the compressor's operating condition, however, as will become evident from the description below, this will not adversely affect the operation of the present invention.

Figure 4:
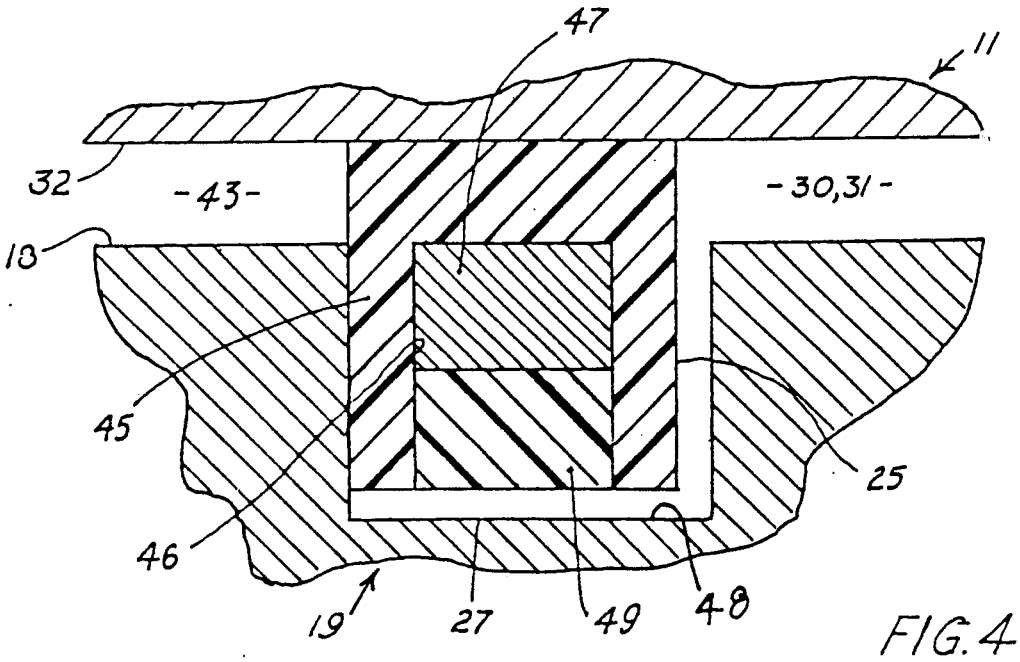
FIG. 4 is an enlarged sectional view showing a first embodiment of a magnetic seal used in the present scroll type compressor.

Referring now to FIG. 4, circular seal 25 having a rectangular cross section is shown seated in a rectangular groove 27 with the top of the seal riding in sealing contact against the bottom surface 32 of the orbiting scroll 11. When the orbiting scroll is moving, a gap 43 is established between the bottom surface of the scroll 32 and the opposing surface 18 of the compressor casing. Pressurized fluid from the compressor is fed into the two back pressure regions bounded by the seals which, in turn, forces the seals outwardly into sealing contact against the outside wall of the groove.

Seal 25 includes a body section 45 having a slotted opening 46 passing upwardly through its bottom wall. The body is formed of any suitable material that is capable of forming a leak tight joint against the orbiting scroll and the bottom surface of the outer wall of the receiving groove. A permanent magnet 47 is mounted within the body opening which rests against the bottom wall of the opening, as shown. The opening is closed by means of a closure wall 49 which is secured in assembly by means of an epoxy resin, or the like.

In this particular embodiment of the invention, both the, orbiting scroll and the machine casing are formed of a magnetically permeable material. Permanent magnet 47 has a residual strength that is great enough to lift the seal from the floor 48 of the groove and hold the top of seal against the bottom surface 32 of the orbiting scroll. The magnet extends along the entire length of the circular seal to insure that the seal is securely closed against the scroll when the machine is in a start-up mode, an operational mode or a shut down mode. The seal is allowed to float within the groove so that it will conform to changes in gap spacing while at the same time accommodating the movement of the orbiting scroll. In addition, the magnetic flux field attracts and hold the seal securely against the outer wall of the receiving groove.

It should be evident from the disclosure above, the pressurized fluid that is delivered into the isolated chamber regions will exert an upwardly directed biasing force against the orbiting scroll. The pressure in the chambers can also change in response to changes in the compressor fluids, thereby preventing an unbalanced condition from occurring In addition, the biasing pressure holds the two scrolls in orbiting contact to help minimize leakage in and about the tips of the coacting wraps as well as preventing the orbiting scroll from rubbing against the adjacent stationary machine components.

Figure 5:
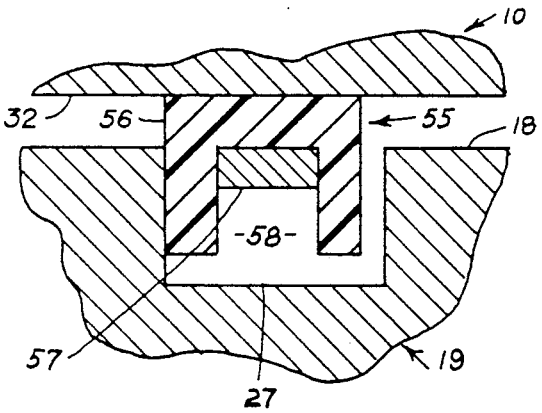
FIG. 5 is a sectional view showing a second embodiment of the magnetic seal used in the present compressor.

FIG. 5 illustrates a further embodiment of the invention in which both the orbiting scroll 10 and the casing 28 are again fabricated of magnetically permeable material. Seal 55 is mounted within the circular grooves 27 and includes a U-shaped body section 56 containing a permanent magnet 57 of the type previously described above. In this particular embodiment, however, an air gap 58 is provided between the bottom of the magnet and the bottom of the groove. The air gap is sufficiently wide so that the seal will not be attracted magnetically toward the bottom of the groove. Accordingly, the seal will be maintained in a lifted or raised position as shown when the compressor is in either an operative or shut down mode.

Figure 6:
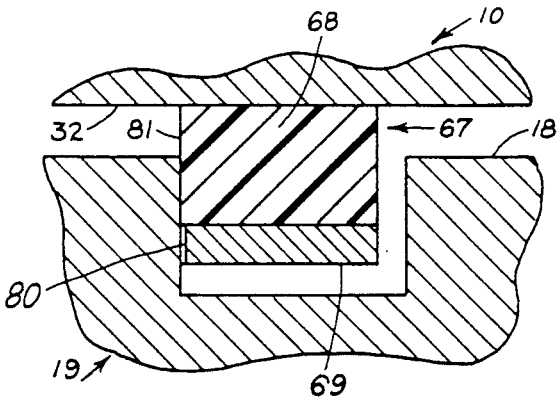
FIG. 6 is a sectional view showing a third embodiment of a seal suitable for use in the present compressor.

Turning now to FIG. 6, there is illustrated a still further embodiment of the present invention wherein the back plate of the scroll 10 is formed of a magnetically permeable material and the casing member is formed of a non-;magnetically permeable material such as aluminum or the like. Seal 67 includes a rectangular shaped body section 68 which is fabricated from any suitable material capable of forming a fluid type joint against the retaining groove wall and the end face of the orbiting scroll. A permanent magnet 69 is securely bonded, as by means of a epoxy resin, against the bottom surface of the seal body. The outside wall 80 of the magnet is retracted slightly inside the outside face 81 of the seal body to prevent it from rubbing or binding against the adjacent groove wall.

Figure 7:
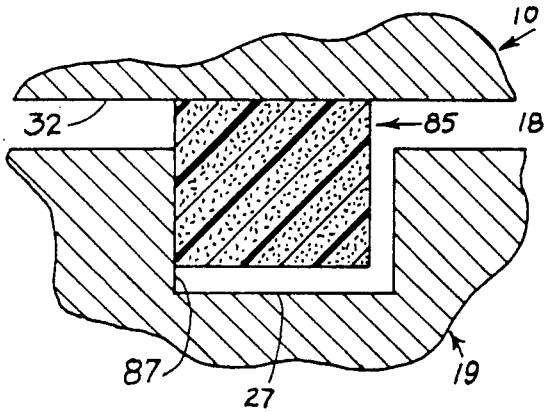
FIG. 7 is a sectional view showing a fourth embodiment of a magnetic seal suitable for use in a scroll type compressor.

FIG. 7 illustrates yet another embodiment of the present invention wherein the back plate of the orbiting scroll is formed of a magnetically permeable material and the casing member is formed of a non-magnetically permeable material. Seal 85, in this particular case, is formed of a composite material, containing a resin in which magnetic particles are encapsulated. The resin material, when cured, is capable of forming a fluid tight seal between the orbiting scroll and the side wall 87 of the retaining grooves.

Figure 8:
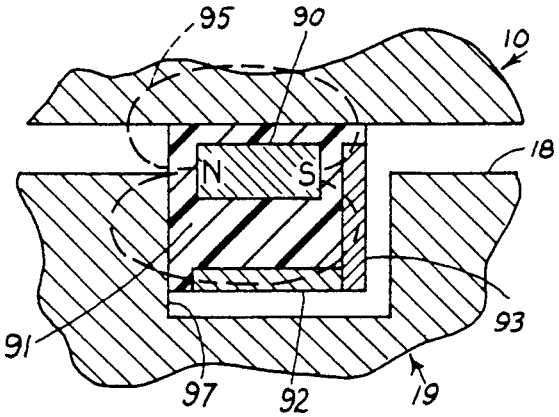
FIG. 8 is also a sectional view showing a fifth embodiment of a seal suitable for use in a scroll type compressor.

Turning now to FIG. 8, there is shown a final embodiment of the present invention in which a permanent magnet 90 is completely encapsulated within a resilient seal body 91. Also contained within the seal body are a lower shunt member 92 and an inner shunt member 93. The shunt members serve to prevent magnetic lines of flux 95 from reaching the bottom wall and the inner side wall of the groove. Accordingly, the seal member will be magnetically attracted to the bottom face of the orbiting scroll 10 and the outer wall 97 of the retaining groove.

While this invention has been explained with specific detail to the structure disclosed herein, it is not confined to the details as set forth in this application and is intended to cover any modifications and changes as may come with the scope of the following claims.

What is claimed is:

1. Sealing apparatus for use in scroll compressor that has a fixed scroll and an orbiting scroll, said apparatus including;

a stationary casing in the compressor having a flat back face formed of a magnetically permeable material, an orbiting scroll mounted adjacent said casing, said orbiting scroll having a flat back face formed of a magnetically permeable material, said back face being in parallel alignment with the flat surface on said casing.

drive means for moving said orbiting scroll in the plane of said flat face whereupon a gap is established between the flat surface on said casing and said back face when said orbiting scroll is in motion, at least one endless groove means formed in a magnetically permeable section of the flat surface of said casing, said groove means having a rectangular cross-section that includes an outer wall, an inner side wall and a bottom wall, an endless seal means loosely mounted within said groove means for defining a back pressure chamber inside said seal means, said seal means having a rectangular cross-section that includes opposed inner and outer side walls and opposed top and bottom walls with the outer side wall of the seal being in sliding contact with the outer side wall of the groove means, magnetic means associated with the seal means for magnetically lifting the seal means and holding said top surface thereof in contact against the back face of the orbiting scroll and the outer side wall of the seal means against the outer side wall of the groove means to establish a space between the bottom wall of the seal means and the bottom wall of the groove means and the inner side wall of the seal means and the inner side wall of the groove means, and means to bring pressurized fluid into the back pressure chamber whereby said fluid exerts a sealing pressure on the inner side all and bottom wall of the seal means.

2. The apparatus of claim 1 wherein said groove means includes a series of circular grooves situated one inside the other each having seal means therein to define a plurality of back pressure chambers between the orbiting scroll and the stationary casing.

3. The apparatus of claim 2 that further includes means for bringing pressurized fluid at different pressures into the back pressure chambers.

4. The apparatus of claim 3 that further includes passage means for connecting the innermost back pressure chamber to an area of maximum pressure within said compressor and each radially disposed back pressure chamber to an area of lesser pressure.

5. The apparatus of claim 1 wherein said seal means further includes a body section for contacting said sealing surfaces on the stationary casing and the orbiting scroll and a permanent magnet enclosed within said body section for magnetically holding said seal means against said surfaces.

6. A method of forming a seal between the orbiting scroll of a scroll compressor and an adjacent stationary casing of the compressor that includes the steps of forming opposing flat surfaces on the orbiting scroll and the stationary casing of a magnetically permeable material, forming at least one endless groove in the flat surface of said casing having two opposed side walls and a bottom wall, loosely mounting an endless seal having a rectangular cross-section in said groove so that the outer side wall of the seal rests in contact against the outer side wall of the groove, magnetically lifting and holding the top surface of the seal in contact against the flat surface of the orbiting scroll and against said outer side wall of said groove to establish a space between the bottom wall of the seal and the bottom wall of the groove and the inner side walls of the seal and the inner side walls of the groove, introducing a fluid under pressure inside the seal so that the fluid exerts a sealing pressure against the inner side wall and the bottom wall of the seal, and moving the orbiting scroll in the plane of said flat surface thereon whereby the seal retains fluid therein as the scroll orbits.

7. The method of claim 6 that further includes the steps of forming a series of endless grooves in the casing with the groove being positioned one inside the other to form a series of radially-disposed back pressure chambers, and introducing fluid under different pressures into each chamber.

* * * * *